US005878741A

United States Patent [19]

Dempsey et al.

[11] Patent Number: 5,878,741

[45] Date of Patent: Mar. 9, 1999

[54] DIFFERENTIAL PRESSURE MODULATED GAS VALVE FOR SINGLE STAGE COMBUSTION CONTROL

[75] Inventors: Daniel J. Dempsey, Carmel, Ind.; William J. Roy, Springfield, Tenn.

[73] Assignee: Carrier Corporation, Syracuse, N.Y.

[21] Appl. No.: 810,230

[22] Filed: Mar. 3, 1997

[51] Int. Cl.[6] ..... F24H 3/00

[52] U.S. Cl. ..... 126/116 A; 431/70

[58] Field of Search ..... 126/116 R, 116 A; 431/20

[56] References Cited

U.S. PATENT DOCUMENTS

| | | | |
|---|---|---|---|
| 4,483,672 | 11/1984 | Wallace et al. | 431/20 |
| 4,708,636 | 11/1987 | Johnson | 431/20 |
| 5,601,071 | 2/1997 | Carr et al. | 431/20 |

*Primary Examiner*—Carroll B. Dority

[57] ABSTRACT

An apparatus senses the pressure changes in a collector box or relief box of a furnace due to changing wind conditions, and adjusts the gas flow accordingly. The apparatus controls the main gas valve of the furnace through a regulator loop. The regulator loop has a first port that communicates with a chamber below the main diaphragm of the valve, and a second port that communicates with a chamber above the main diaphragm. The regulator includes two diaphragms linked rigidly. A feedback pressure channel is connected to the collector box or the relief box, at one end, and to a feedback pressure tap at the other end. An increase in wind at the furnace vent causes changes in pressure in the collector box and the relief box. This change in pressure is delivered to the feedback pressure tap. When the pressure at the feedback pressure tap increases, the top diaphragm and the bottom diaphragm both move upward. As the pair of diaphragms move upward, there is relatively more flow through the second port and relatively less through the first port, causing a pressure differential across the main diaphragm; a higher pressure then exists above the main diaphragm compared to the pressure below the main diaphragm. The main valve then moves toward the closed position. When the pressure at the feedback pressure tap decreases, the diaphragms move down. This causes relatively more flow through the first port and relatively less flow through the second, causing the valve to open.

6 Claims, 4 Drawing Sheets

DIFFERENTIAL PRESSURE MODULATED GAS VALVE FOR SINGLE STAGE COMBUSTION CONTROL

BACKGROUND OF THE INVENTION

1. Field of the Invention

This invention relates in general to an apparatus for controlling gas flow for combustion in a furnace. More particularly, the invention relates to an improved valve for adjusting the gas flow in a furnace in response to downstream pressure changes.

2. Discussion of the Related Art

In conventional gas-fired forced air furnaces a thermostat senses the temperature in the comfort zone relative to a predetermined set point temperature. When the temperature is below the set point, the thermostat closes to supply thermostat ac power to the furnace as a call for heat. This initiates a sequence of events that ultimately causes the furnace to come on. A draft inducer motor is enabled to flow air through the heat exchangers for combustion, after which a gas valve is actuated to supply gas to the gas burners. An ignition device is also actuated to light the burners. A flame sensor then proves burner ignition. Then, after a predetermined blower delay time, which varies with furnace design, the furnace blower is actuated. The blower circulates room air from the return air duct over the furnace heat exchangers to pick up heat from the hot combustion products (carbon dioxide and water vapor). The heated circulating air then goes into the supply air plenum and is distributed by ductwork back to the living space. When the living space is warmed sufficiently to reach the thermostat set point, the thermostat terminates the call for heat. When this happens, the blower and burners go through a shut off sequence and the furnace awaits the next call for heat.

The present invention relates to the control of gas flow to the burners. When the draft inducer motor is in operation, a substantial step-up in pressure occurs between the intake of the draft inducer housing (the collector box) on the one hand, and the outflow of the draft inducer housing (the relief box) on the other hand. Typically there is negative pressure (relative to atmospheric pressure) at the intake, and positive pressure at the outlet.

The negative pressure is used to draw combustion air through the furnace heat exchangers. The positive pressure results when the furnace is installed as a category III vented appliance. Under certain outside conditions, such as high wind conditions, back pressure on the vent causes the draft inducer to become overloaded. The overloading of the draft inducer prohibits the device from providing the air required for proper combustion. Operating under this lean condition, the furnace can produce unwanted products of combustion, such as carbon monoxide. Therefore, an apparatus is needed which senses the pressure changes caused by changing wind conditions and adjusts the gas flow to the burners accordingly.

SUMMARY OF THE INVENTION

An apparatus is provided for improving the application of a furnace. The present invention provides an apparatus for sensing the pressure changes in the collector box or relief box and adjusts the gas flow accordingly. The apparatus includes a gas valve with an inlet for the introduction of gas into the valve. The gas enters the inlet of the valve and first flows through a manual shutoff valve, the gas continues to flow through a redundant valve, and then flows through the main valve to the outlet. The main valve is controlled by a main diaphragm and is biased in the closed direction as a failsafe. From the outlet, the gas enters a manifold which supplies gas to the burners.

The main valve is adjusted by a regulator loop. A portion of the gas flow into the main valve is diverted into the regulator loop. The regulator loop has two ports, a first port that communicates with a chamber below the main diaphragm and a second port that communicates with a chamber above the main diaphragm. The regulator includes two diaphragms, a top diaphragm and a bottom diaphragm, defining a feedback chamber therebetween. The diaphragms defining the feedback chamber are designed such that the top diaphragm dominates the movement of the bottom diaphragm. The diaphragms are linked in such a way that both diaphragms move in the same direction in response to pressure changes in the feedback chamber. Preferably, the diaphragms are rigidly linked, however they may also be linked by a biasing means, such as a spring. Thus, an increase in pressure in the feedback chamber causes both diaphragms to move upward which decreases the gas flow through the valve. A decrease in pressure in the feedback chamber causes both diaphragms to move downward which increases the gas flow through the valve.

The feedback pressure chamber is connected via a rubber tube to either the collector box at the inlet of the draft inducer or the relief box at the outlet of the draft inducer. If the feedback pressure chamber is connected to the collector box, an increase in wind at the furnace vent causes less negative pressure in the collector box. This change in pressure is delivered to the feedback pressure chamber. When this occurs, the net pressure in the feedback pressure chamber is increased, thus decreasing the gas flow.

If the feedback pressure chamber is connected to the relief box, an increase in wind at the vent causes the pressure at the relief box to increase. This change in pressure is delivered to the feedback pressure chamber. When the pressure in the feedback pressure chamber increases, this also decreases the gas flow.

As the pair of diaphragms move upward, there is relatively more flow through the second port and relatively less flow through the first port. Because the second port communicates with the area above the main diaphragm and the first port communicates with the area below the main diaphragm, this causes a pressure differential across the main diaphragm so that a higher pressure exists above the main diaphragm compared to the pressure below the main diaphragm. This causes the main valve to move toward the closed position, thus reducing the gas flow to the burners.

When the pressure at the feedback pressure tap decreases, the upper and lower diaphragms move down. This causes relatively more flow through the first port and relatively less flow through the second port, resulting in an increase in pressure below the main diaphragm. This causes the main diaphragm to rise, thus moving the valve in the open direction. The opening of the valve allows greater gas flow to the burners.

These and other details, advantages and benefits of the present invention will become apparent from the detailed description of the preferred embodiment hereinbelow.

BRIEF DESCRIPTION OF THE DRAWINGS

The preferred embodiment of the invention will now be described, by way of example only, with reference to the accompanying Figures wherein like members bear like reference numerals and wherein.

DETAILED DESCRIPTION OF A PREFERRED EMBODIMENT

Figure 1:
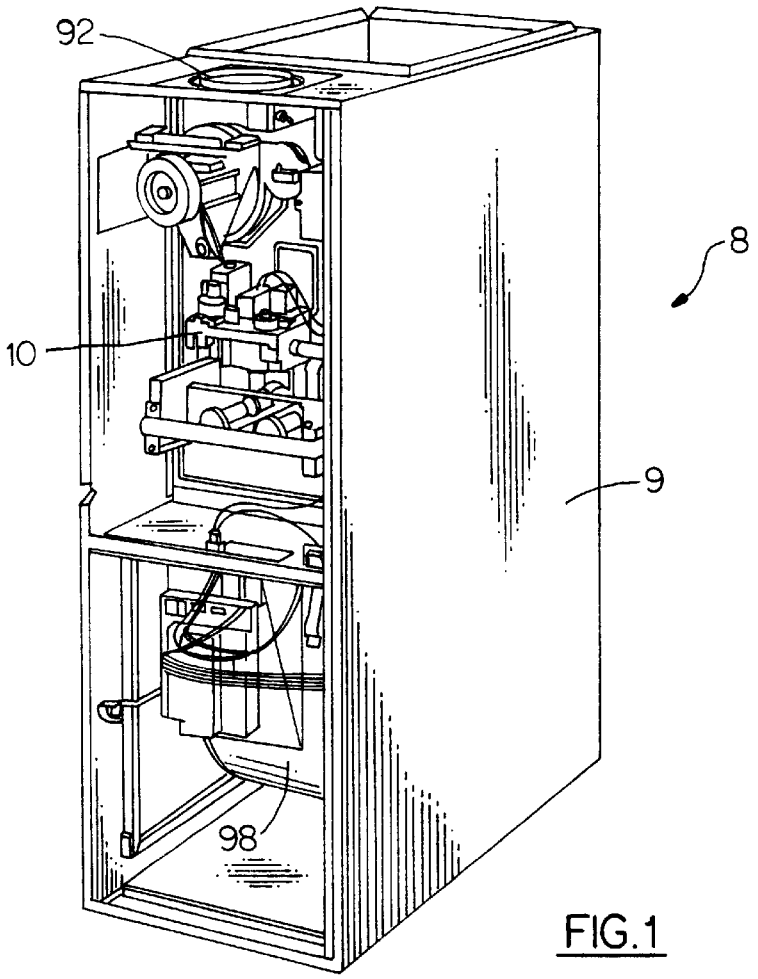
FIG. 1 is a perspective view of a furnace including the present invention.

Referring now to the drawings, which are for the purpose of illustrating the preferred embodiment of the invention and not for the purpose of limiting the same, FIGS. 1–5 show the present invention in connection with a furnace 8. The furnace 8 can be any conventional gas fired furnace. As shown in FIGS. 1, 3*a* and 3*b*, the furnace 8 includes an outer housing 9 which surrounds the components of the furnace 8. The furnace 8 includes a gas valve 10 which receives gas from an external source. The gas valve 10 includes an inlet port 12 and an outlet port 60. Gas, represented by arrows 14, flows through the valve 10 and outlet port 60 to the burners 70. The gas is ignited in the burners 70 and produces hot combustion products, represented by the arrows 72. The hot combustion products 72 are drawn through heat exchangers 80 by a draft inducer 82. The draft inducer 82 has a collector box 84 near its inlet 86 and a relief box 88 near its outlet 90. The hot combustion products 72 then pass through the vent pipe 92 to the outside (not shown). Room air, represented by arrows 94 is forced over the heat exchangers 80 by the blower 98. The room air 94 passes over the heat exchangers 80 to pick up heat from the heat exchangers 80 to warm the room air 94.

Figure 2:
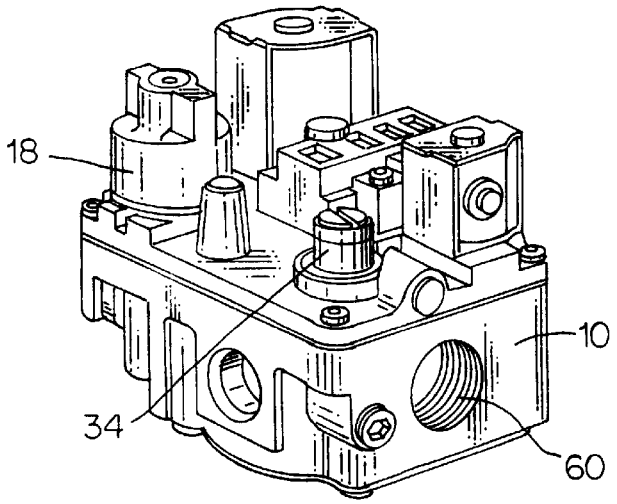
FIG. 2 is a perspective view of the valve of the present invention.
Figure 4:
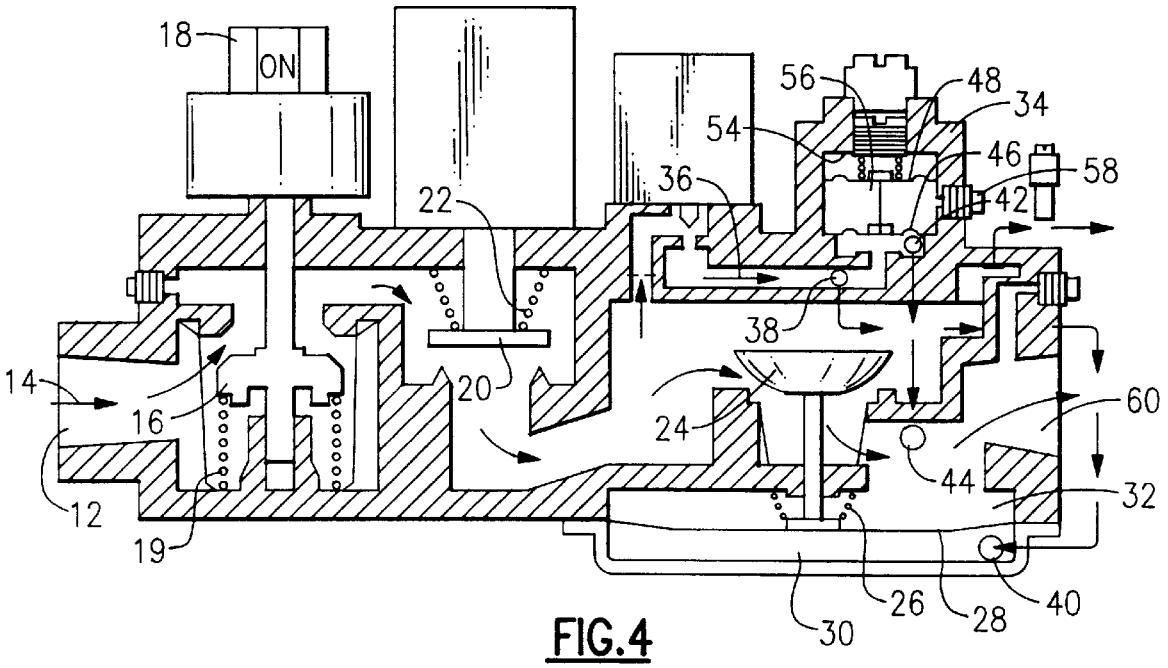
FIG. 4 is a cross sectional view of the valve of the present invention.
Figure 5:
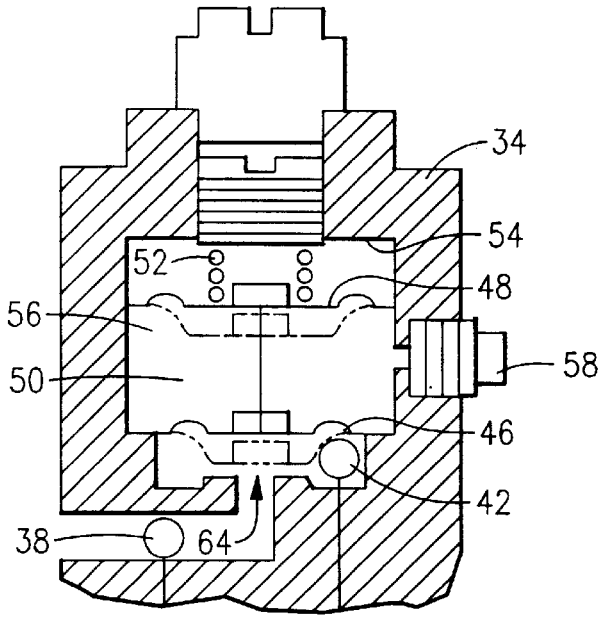
FIG. 5 is an enlarged cross sectional view of the regulator of the present invention.

Referring to FIGS. 2, 4 and 5, the gas valve 10 will be described in detail. The gas valve 10 receives gas 14 at the inlet port 12. The gas 14 flows past a manual valve 16. The manual valve 16 is controlled by a manual gas knob 18 and is biased in the closed position by a spring 19. The gas 14 then flows to a redundant valve 20 which is also biased in the closed position by a spring 22. The gas 14 then flows to a main valve 24 which is biased in the closed position by a spring 26. The main valve 24 is controlled by a diaphragm 28. The diaphragm 28 has an chamber 30 below the diaphragm 28 and a chamber 32 above the diaphragm 28. Changes in gas pressure in chambers 30 and 32 control movement of the main valve 24.

The gas pressure in chambers 30 and 32 is determined by a regulator 34. The regulator 34 receives gas 14 diverted from the main valve 24 into a regulator loop 36. The regulator loop 36 includes a first port 38 in communication with a port 40 below diaphragm 28. The regulator loop 36 also includes a second port 42 in communication with a port 44 above the diaphragm 28. The gas flow through ports 38 and 42 is determined by the positions of a lower diaphragm 46 in regulator 34 and an upper diaphragm 48 in regulator 34. Preferably, the diaphragms 46 and 48 are rigidly connected. Preferably, a spring 52 is disposed between the upper diaphragm 48 and the top of the regulator 54. This spring is for outlet pressure adjustment. A feedback chamber 56 is created between the diaphragms 46 and 48. With diaphragms 46 and 48 rigidly connected (50), they move in the same direction. Since diaphragm 48 is larger, it will determine the direction of movement for any changes in pressure in the feedback chamber 56.

Figure 3A:
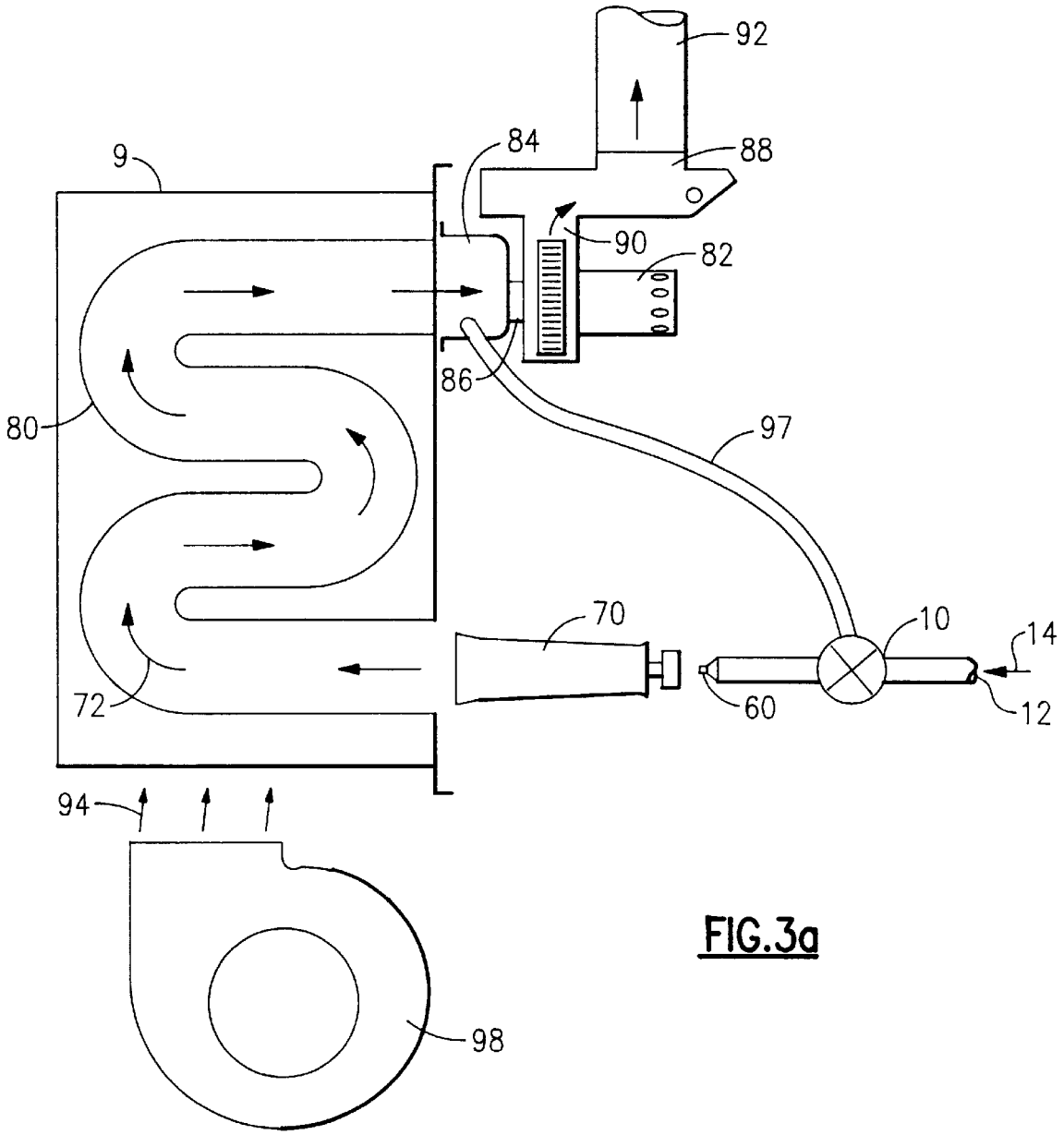
FIG. 3*a* is a diagrammatic representation of the furnace including the present invention.
Figure 3B:
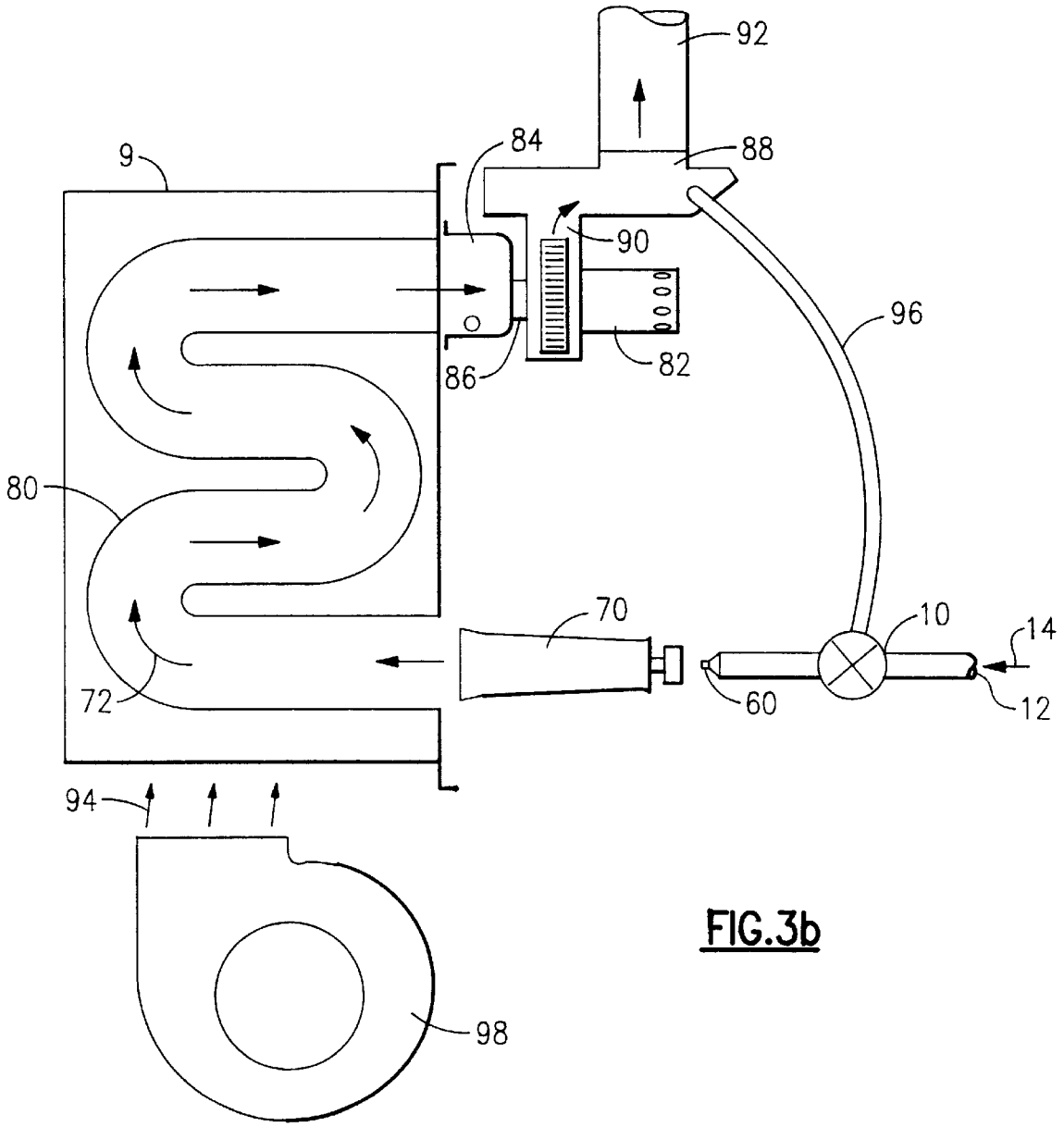
FIG. 3*b* is a diagrammatic representation of the furnace including the present invention.

The feedback chamber 56 receives pressure from a feedback pressure tap 58. The feedback pressure tap 58 is in fluid communication with either the collector box 84 or the relief box 88. FIG. 3*b* shows the feedback pressure tap 58 in communication with the relief box 88 through channel 96. FIG. 3*a* shows the feedback pressure tap 58 in communication with the collector box 84 through channel 97. Therefore, pressure changes in the relief box 88 will be transmitted to the feedback chamber 56. The pressure changes in the collector box (84) and relief box (88) can be due to outside wind conditions which cause pressure changes in the vent (92). If the vent pressure increases, the relief box (88) pressure becomes more positive and the collector box (84) pressure becomes less negative.

When pressure in the feedback chamber 56 increases, the diaphragms 46 and 48 rise. As this occurs, the opening 64 becomes larger and more gas flows to port to the second port 42. Increased gas flow to the second port 42 causes an increase in gas pressure in chamber 32 above the diaphragm 28. This causes the diaphragm 28 to move down and cause the main valve 24 to move toward the closed position.

When pressure in the feedback chamber 56 decreases, the diaphragms 46 and 48 fall. This causes the opening 64 to become smaller and more gas flows to the first port 38. More gas flow to the first port 38 causes an increase in pressure in chamber 30 below the diaphragm 28 . This causes the diaphragm 28 to rise and causes the main valve 24 to move toward the open position. Therefore, gas flow to the burners is decreased when an increase in wind at the vent decreases air flow to the burners and gas flow to the burners is increased when a decrease in wind increases air flow to the burners.

While this invention has been described in detail with reference to a preferred embodiment, it should be appreciated that the present invention is not limited to that precise embodiment. Rather, in view of the present disclosure which describes the best mode for practicing the invention, many modifications and variations would present themselves to those of skill in the art without departing from the scope and spirit of this invention, as defined in the following claims.

What is claimed is:

1. A gas control valve for controlling gas flow to a burner of a furnace, the furnace having a draft inducer, a collector box, a relief box and a vent, the gas control valve comprising:

an inlet for receiving a flow of gas;

a main valve for controlling the flow of gas to the burner, having an inlet side and an outlet side in fluid communication with said inlet, said main valve having an open position and a closed position;

means for sensing changes in pressure at the vent; and means for moving said main valve in response to said means for sensing in a modulating manner such that an increase in pressure at said vent causes gas flow to decrease through said main valve and a decrease in pressure at said vent causes gas flow to increase through said main valve.

2. A gas control valve for controlling gas flow to a burner of a furnace, the furnace having a draft inducer, a collector box and a relief box, the gas control valve comprising:

an inlet for receiving a flow of gas;

a main valve for controlling the flow of gas to the burner, having an inlet side and an outlet side in fluid communication with said inlet, said main valve having an open position and a closed position;

means for moving said main valve;

a control loop in fluid communication with said inlet for receiving a portion of the flow of gas to said main valve;

a flow regulator;

a first diaphragm and a second diaphragm in said flow regulator defining a feedback chamber therebetween;

a feedback pressure tap in fluid communication with said feedback chamber and the relief box such that pressure changes in the relief box are transmitted to said feedback chamber;

said first diaphragm constructed with a larger area than the second diaphragm, said diaphragms are connected so they move in unison with each other, the diaphragms are constructed such that changes in pressure in said feedback chamber causes said first and second diaphragms to move; and means for controlling said main valve in response to movement of said first and second diaphragms such that an increase in pressure in said feedback chamber cause said main valve to move in the closed direction and a decrease in pressure in said feedback chamber causes said main valve to move in the open direction.

3. A gas control valve for controlling gas flow to a burner of a furnace, the furnace having a draft inducer, a collector box and a relief box, the gas control valve comprising:

an inlet for receiving a flow of gas;

a main valve for controlling the flow of gas to the burner, having an inlet side and an outlet side in fluid communication with said inlet, said main valve having an open position and a closed position;

means for moving said main valve;

a control loop in fluid communication with said inlet for receiving a portion of the flow of gas to said main valve;

a flow regulator;

a first diaphragm and a second diaphragm in said flow regulator defining a feedback chamber therebetween;

a feedback pressure tap in fluid communication with said feedback chamber and the collector box such that pressure changes in the collector box are transmitted to the feedback chamber;

said first diaphragm constructed with a larger area than the second diaphragm, said diaphragms are connected so they move in unison with each other, the diaphragms are constructed such that changes in pressure in said feedback chamber cause said first and second diaphragms to move; and means for controlling said main valve in response to movement of said first and second diaphragms such that an increase in pressure in said feedback chamber causes said main valve to move in the closed direction and a decrease in pressure in said feedback chamber causes said main valve to move in the open direction.

4. The gas control valve of claim 2 wherein said means for moving said main valve comprises a main diaphragm connected to said main valve such that movement of said main diaphragm moves said main valve, a first chamber on one side of said main diaphragm, and a second chamber on the other side of said main diaphragm and wherein said means for controlling said main valve includes a first port in said control loop in fluid communication with said first chamber, and a second port in said control loop in fluid communication with said second chamber, and wherein said diaphragms are connected so they move in unison with each other, the diaphragms are constructed such that an increase in pressure in said feedback chamber causes said first and second diaphragms to move upward, increases gas flow through said second port and decreases gas flow through said first port and a decrease in pressure in said feedback chamber causes said first and second diaphragms to move downward, decreases gas flow through said second port and increases gas flow through said first port such that an increase in pressure in said feedback chamber causes pressure to increase in said first chamber of said main valve to move said main valve in the closed direction and a decrease in pressure in said feedback chamber causes pressure to increase in said second chamber of said main valve to move said main valve in the open direction.

5. The gas control valve of claim 3 wherein said means for moving said main valve comprises a main diaphragm connected to said main valve such that movement of said main diaphragm moves said main valve, a first chamber on one side of said main diaphragm and a second chamber on the other side of said main diaphragm, a first port in said control loop in fluid communication with said first chamber and a second port in said control loop in fluid communication with said second chamber and wherein said diaphragms are connected so they move in unison with each other, the diaphragms are constructed such that an increase in pressure in said feedback chamber causes said first and second diaphragms to move upward, increases gas flow through said second port and decreases gas flow through said first port and a decrease in pressure in said feedback chamber causes said first and second diaphragms to move downward, decreases gas flow through said second port and increases gas flow through said first port such that an increase in pressure in said feedback chamber causes pressure to increase in said first chamber of said main valve to move said main valve in the closed direction and a decrease in pressure in said feedback chamber causes pressure to increase in said second chamber of said main valve to move said main valve in the open direction.

6. A method of controlling gas flow through a gas control valve of a furnace having a vent, the method comprising the steps of;

sensing changes in pressure at said vent;

modulating gas flow through the gas control valve in response to changes in pressure at said vent such that increases in pressure at said vent decrease gas flow through said gas control valve and decreases in pressure at said vent increase gas flow through said gas control valve.

* * * * *